US009284096B2

(12) United States Patent
Kessler, Jr. et al.

(10) Patent No.: US 9,284,096 B2
(45) Date of Patent: Mar. 15, 2016

(54) GUSSET GRIP CONTAINERS AND METHODS FOR THE MANUFACTURE THEREOF

(71) Applicant: Printpack Illinois, Inc., Elgin, IL (US)

(72) Inventors: David J. Kessler, Jr., Atlanta, GA (US); Brenton Holloway, Smyrna, GA (US); Mark Ronald Brogan, Atlanta, GA (US)

(73) Assignee: Printpack Illinois, Inc., Elgin, IL (US)

( * ) Notice: Subject to any disclaimer, the term of this patent is extended or adjusted under 35 U.S.C. 154(b) by 0 days.

(21) Appl. No.: 14/584,647

(22) Filed: Dec. 29, 2014

(65) Prior Publication Data

US 2015/0183554 A1 Jul. 2, 2015

Related U.S. Application Data

(60) Provisional application No. 61/921,701, filed on Dec. 30, 2013.

(51) Int. Cl.

| | |
|---|---|
| ***B31B 1/90*** | (2006.01) |
| ***B31B 1/84*** | (2006.01) |
| ***B31B 1/60*** | (2006.01) |
| ***B65D 33/06*** | (2006.01) |
| ***B65D 33/08*** | (2006.01) |
| ***B65D 75/56*** | (2006.01) |
| ***B65D 75/58*** | (2006.01) |

(52) U.S. Cl.

CPC ..... *B65D 33/065* (2013.01); *B65D 33/08* (2013.01); *B65D 75/563* (2013.01); *B65D 75/566* (2013.01); *B65D 75/5816* (2013.01)

(58) Field of Classification Search

CPC ..... B65D 33/065; B65D 33/08; B31B 1/60; B31B 1/84; B31B 1/90

USPC ..... 383/61.3

See application file for complete search history.

(56) References Cited

U.S. PATENT DOCUMENTS

| | | | | |
|---|---|---|---|---|
| 7,018,099 | B2 * | 3/2006 | Caudle | 383/104 |
| 7,658,286 | B2 * | 2/2010 | Murray | 206/459.1 |
| 8,007,174 | B2 * | 8/2011 | Yamaguchi et al. | 383/9 |
| 8,240,915 | B2 * | 8/2012 | Sargin et al. | 383/94 |
| 2008/0253696 | A1 | 10/2008 | Haas et al. | |

* cited by examiner

*Primary Examiner* — Christopher Demeree

(74) *Attorney, Agent, or Firm* — Sutherland Asbill & Brennan LLP

(57) ABSTRACT

Containers and methods for their manufacture are provided. Containers include first and second panels connected at first and second edges, a bottom panel connecting the first and second panels at a third edge, a panel area defined by a seal extending from the first edge and having a first aperture at a first corner of the container, and a pour feature disposed at least partially at a second corner diagonally opposite the first corner, wherein the bottom panel or the first edge comprises a gusset. Methods include forming such container and forming at least one aperture in the panel area.

15 Claims, 8 Drawing Sheets

GUSSET GRIP CONTAINERS AND METHODS FOR THE MANUFACTURE THEREOF

CROSS-REFERENCE TO RELATED APPLICATIONS

This application claims priority to U.S. Provisional Application No. 61/921,701, filed on Dec. 30, 2013, which is incorporated by reference herein.

TECHNICAL FIELD

The present disclosure relates generally to containers and container manufacturing, and more specifically to containers having a gusset grip feature and methods for the manufacture thereof.

BACKGROUND

Containers are known for packaging bulk materials. However, users may struggle to dispense materials from known containers. For example, traditional container handles do not offer the ability to easily pour contents from the container. Moreover, traditional containers for packaging higher net weight (e.g., 10-60 pounds) materials have limited pour ability and handling ability. Accordingly, there is a need for containers having improved product dispensing and handling functionality.

SUMMARY

In one aspect, a container is provided, including: (i) an interior portion for containing a bulk product, (ii) a first panel, (iii) a second panel, the first and second panels being connected at a first edge and at a second edge opposite the first edge, to at least partially define the interior portion, (iv) a bottom panel connecting the first and second panels at a third edge, to at least partially define the interior portion, (v) a panel area having a first aperture at a first corner of the container, the panel area being defined by a seal extending from the first edge, the seal at least partially defining the interior portion, such that the panel area is opposite the interior portion, and (vi) a pour feature disposed at least partially at a second corner diagonally opposite the first corner, the pour feature being in communication with the interior portion and configured to dispense the bulk product, wherein the bottom panel or the first edge comprises a gusset.

In another aspect, a method for making a container is provided, including: (i) forming a container having (a) an interior portion for containing a bulk product, (b) a first panel, (c) a second panel, the first and second panels being connected at a first edge and at a second edge opposite the first edge, to at least partially define the interior portion, (d) a bottom panel connecting the first and second panels at a third edge, to at least partially define the interior portion, (e) a panel area comprising a first aperture at a first corner of the container, the panel area being defined by a seal extending from the first edge, the seal at least partially defining the interior portion, such that the panel area is opposite the interior portion, and (f) a pour feature disposed at least partially at a second corner diagonally opposite the first corner, the pour feature being in communication with the interior portion and configured to dispense the bulk product, wherein the bottom panel or the first edge comprises a gusset, and (ii) forming at least one aperture in the panel area.

DETAILED DESCRIPTION

The present invention addresses the above-described needs by providing containers having improved product dispensing and handling functionality and methods for the manufacture thereof. Several embodiments of containers and methods for making containers are described below. Parameters of different steps, components, and features of the embodiments are described separately, but may be combined consistently with this description and claims to enable still other embodiments as will be understood by those skilled in the art.

Containers

Containers having a gusset grip feature are provided. These containers allow for improved product dispensing and container handling, as compared to known containers.

Figure 1A:
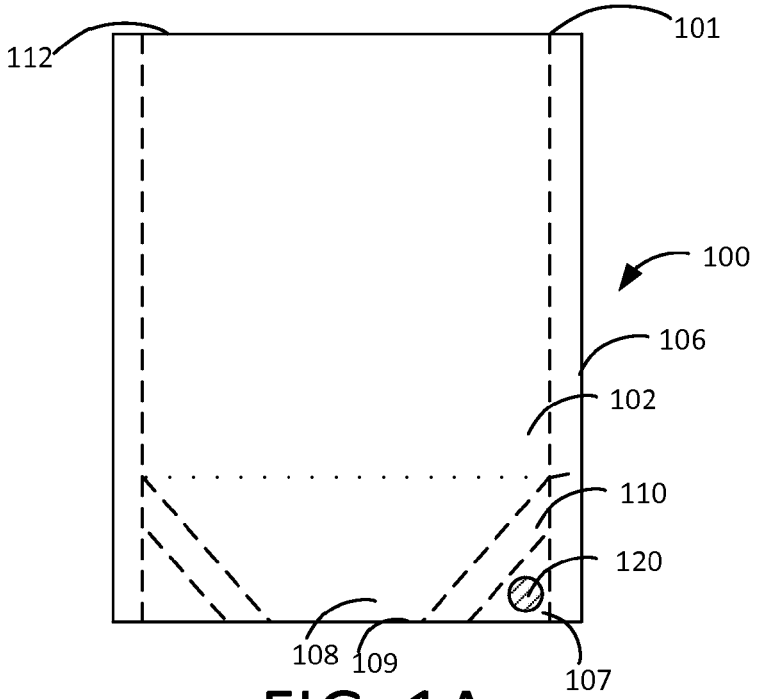
FIG. 1A is a plan view, showing one embodiment of a container having a gusset grip feature.
Figure 1B:
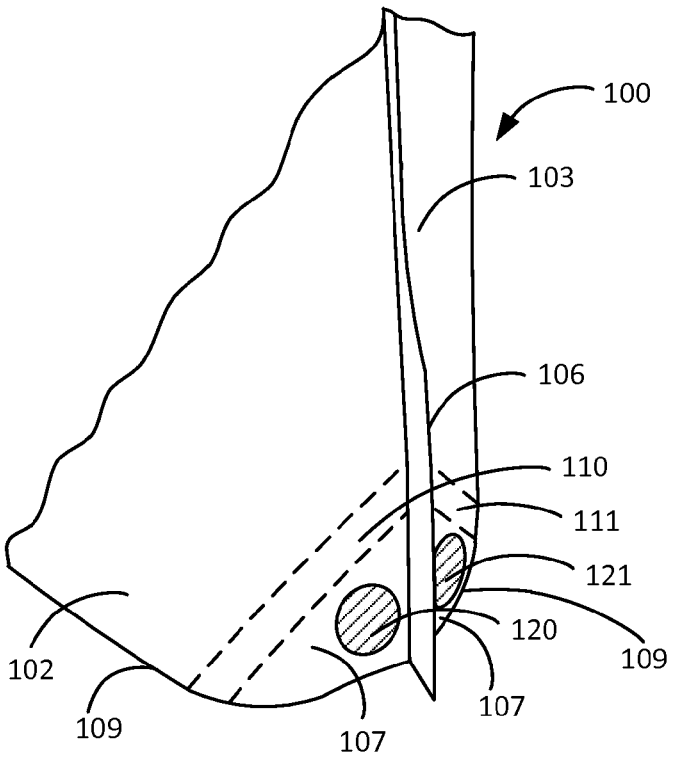
FIG. 1B is a perspective view, showing a portion of the container having a gusset grip feature of FIG. 1A.
Figure 1C:
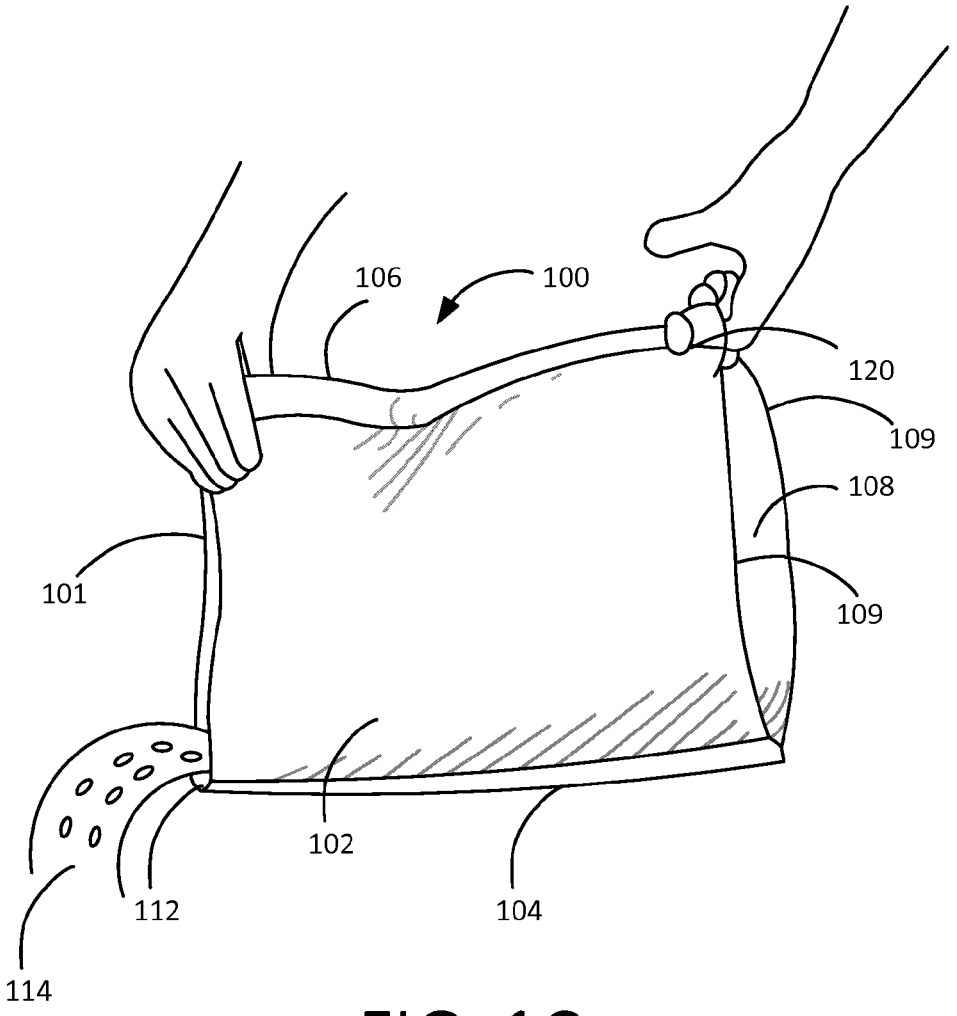
FIG. 1C is a perspective view, showing the container having a gusset grip feature of FIGS. 1A and 1B.

Generally, as shown in FIGS. 1A-1C, these containers 100 include an interior portion for containing a bulk product 114, a first panel 102, and a second panel 103. For example, the first and second panels may form the front and back faces of the container. The first and second panels 102, 103 are connected at a first edge 106 and at a second edge 104 opposite the first edge 106, to at least partially define the interior portion. As described herein, the first and second edges may include a variety of structures, including seals, gussets, and combinations thereof.

A bottom panel 108 connects the first and second panels 102, 103 at a third edge 109, to at least partially define the interior portion. In certain embodiments, the bottom panel supports the container in a standing configuration. A panel area 107 is defined by a seal 110 extending from the first edge 106 and includes a first aperture 120 at a first corner of the container.

The seal 110 at least partially defines the interior portion such that the panel area 107 is opposite the interior portion. That is, the panel area is separate from, or not in communication with, the interior portion of the container, such that the aperture(s) in the panel area does not provide access to the bulk product contained within the interior portion. Thus, the interior portion is sealed from the panel area and aperture(s) contained therein.

A pour feature 112 is disposed at least partially at a second corner diagonally opposite the first corner and is in communication with the interior portion and configured to dispense the bulk product 114. As described herein, the pour feature may include any suitable pour feature, such as a tearable, cuttable, or otherwise removable opening, a recloseable opening, or a fitment, such as a spout. The bottom panel or the first edge of the container is a gusset. Thus, the aperture(s) in the panel area provides a grip feature at or near a gusset of the container, to provide for improved product dispensing and container handling.

The first and second edges may include any gusset, seal, combination thereof, or other suitable edge configuration known to those of ordinary skill in the art. For example, the first and second edges may include one or more fin seals or lap seals. As shown in FIGS. 1A-1C, the bottom panel 108 may be a gusset. For example, the container may be a stand-up pouch style bag, in which the first and second edges are fin or lap seals. As shown in FIGS. 2A-2C and 3A-3B, the first edge 206 may be a gusset. For example, the container may be a quad-seal bag, in which the first and second edges are gussets having sealed edges. Thus, the containers may have a side-gusseted or bottomed-gusseted (e.g., Doyen-style) configuration, with the gusset grip feature provided at a corner of the container formed by a gusset.

In certain embodiments, as shown in FIGS. 1A-1C, the fourth edge 101, which extends between the first and second edges 106, 104, includes any suitable seal and wholly or partially contains the pour feature 112.

In certain embodiments, as shown in FIGS. 1A-1C, the panel area 107 is defined by a pair of angled seals 110, 111 extending between the first edge 106 and the third edge 109, which includes a gusseted bottom panel 108. In some such embodiments, the first aperture 120 is disposed between a first of the pair of angled seals 110 and the first edge 106, and the panel area 107 further comprises a second aperture 121 disposed between a second of the pair of angled seals 111 and the first edge 106. The first and second apertures 120, 121 are also disposed between the angled seals 110, 111 and the third edge 109.

Figure 2A:
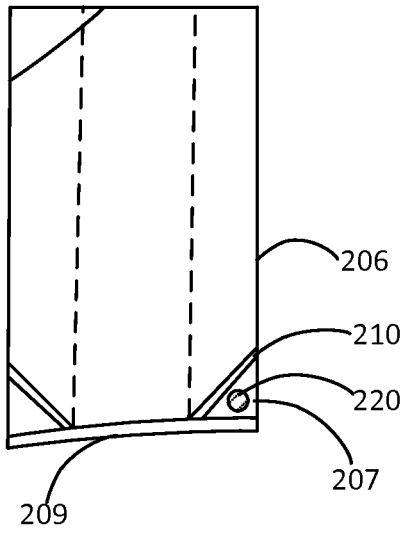
FIG. 2A is a plan view, showing one embodiment of a container having a gusset grip feature.
Figure 2B:
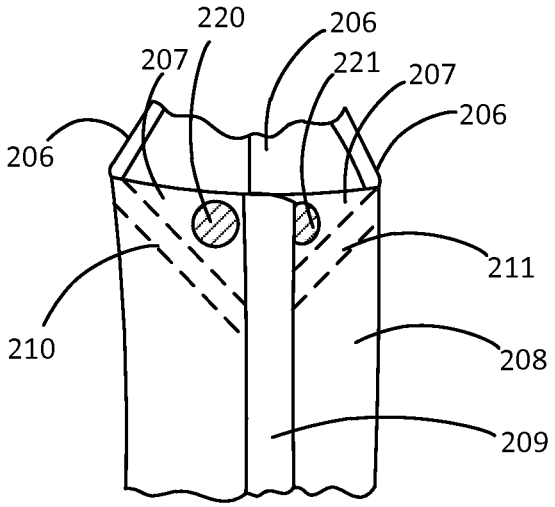
FIG. 2B is a perspective view, showing a portion of the container having a gusset grip feature of FIG. 2A.
Figure 2C:
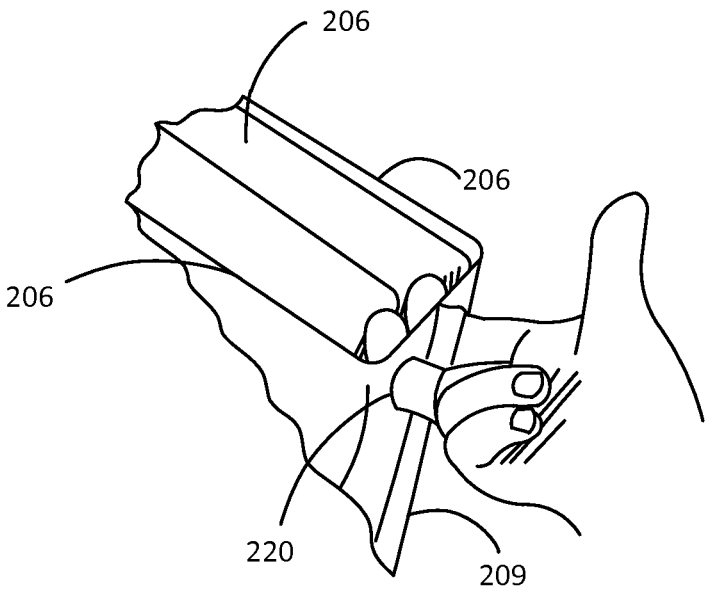
FIG. 2C is a perspective view, showing a portion of the container having a gusset grip feature of FIGS. 2A and 2B.

In certain embodiments, as shown in FIGS. 2A-2C, the panel area 207 is defined by a pair of angled seals 210, 211, extending between the first edge 206, which includes a gusset, and the third edge 209, which includes the bottom panel 208. For example, the bottom panel may include a fin or lap seal, and may be configured to support the container in a standing configuration. The first aperture 220 is disposed between a first of the pair of angled seals 210 and the first edge 206, and the panel area 207 further comprises a second aperture 221 disposed between a second of the pair of angled seals 211 and the first edge 206. The first and second apertures 220, 221 are also disposed between the angled seals 210, 211 and the third edge 209.

In one embodiment, the angled seals are K-seals. The angled seals may be heat seals, adhesive seals, or other suitable seals known to those of ordinary skill in the art. In one embodiment, the angled seals are provided at a 30 degree angle relative to the gusset. In another embodiment, the angled seals are provided from about a 20 degree angle to about a 60 degree angle, relative to the gusset.

Figure 3A:
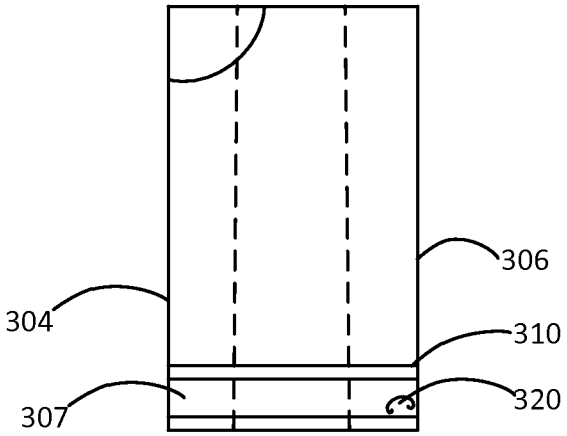
FIG. 3A is a plan view, showing one embodiment of a container having a gusset grip feature.
Figure 3B:
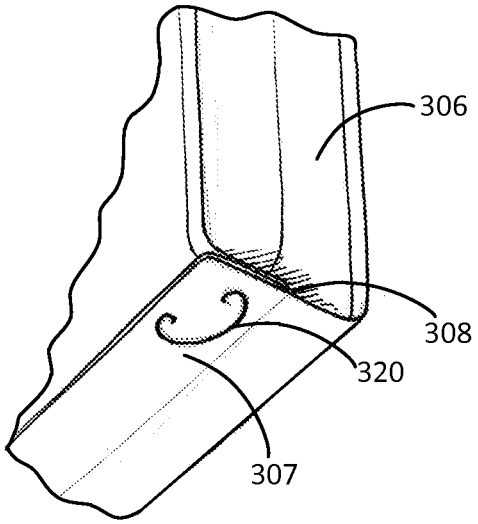
FIG. 3B is a perspective view, showing a portion of the container having a gusset grip feature of FIG. 3A.

In certain embodiments, as shown in FIGS. 3A-3B, the seal 310 defining the panel area 307 extends between the first edge 306, which includes a gusset, and the second edge 304. The bottom panel 308 is covered by a flap including the panel area 307, which has an aperture 320 therein.

The seal-panel area configurations disclosed herein are exemplary only and are not intended to limit the scope of the appended claims. Rather, additional configurations of the seal-panel area in which the panel area does not form the interior portion of the container are envisioned and are intended to fall within the scope of the present disclosure. That is, the panel area does not contact any bulk product contained within the interior portion of the container. Thus, the location of the aperture(s) at the panel area advantageously provides a grip feature at or near the gusset with no possibility of product leakage, because the panel area is not in communication with the interior portion of the container.

As used herein, the term "bulk product" refers to any flowable material or product, such as dry powder or particulate materials, or fluids, including pet food, sand, soil, plant nutrients, salt pellets, grain, cereal, gravel, and coal. For example, a container having a gusset grip feature may be sized to contain from about 10 to about 60 pounds of the bulk product, such as from about 15 to about 50 pounds, or from about 25 to about 50 pounds. The gusset grip feature may provide an ergonomic means of dispensing the bulk product from the container in a controlled way.

The first and second panels, as well as any additional gusset panel, may be constructed of a flexible material selected from the group consisting of polyethylene, polypropylene, nylon, polyester, cellulosic materials, laminations thereof, and combinations thereof. Additional suitable materials that can be formed into webs or films may also be used. These materials may be oriented, woven, non-woven, spunbound, or laminations thereof. For example, the panels may include a polymeric textile fabric.

Figure 6:
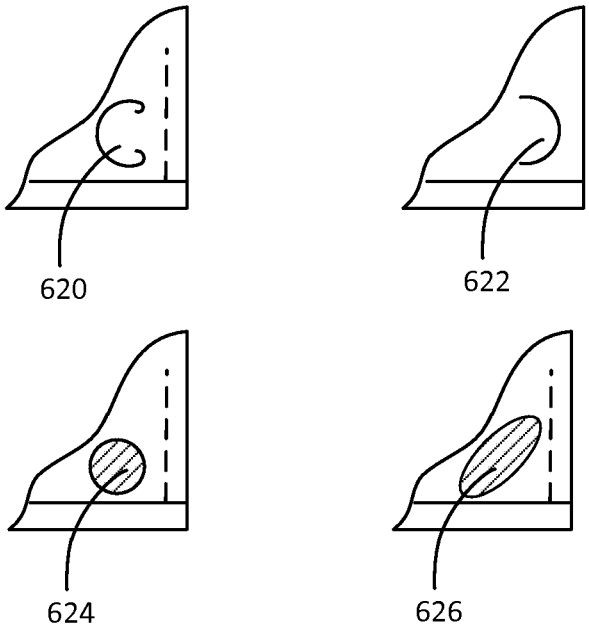
FIG. 6 is a plan view, showing various embodiments of gusset grip feature configurations.

As used herein, the term "aperture" refers to any configuration of opening, hole, or slit that allows a user to insert one or more fingers therethrough. In certain embodiments, the aperture includes a circular, ovoid, or other suitably-shaped opening configured to receive one or more human fingers. In other embodiments, the aperture includes a partial cut and a chad, configured to create an opening sized to receive one or more human fingers. For example, the partial cut may include a forward or reverse C-cut (as shown in FIGS. 3A-3B) or D-cut. FIG. 6 illustrates various embodiments of aperture configurations that may be used in the present containers, including a circular aperture 624, an ovoid aperture 626, a forward C-cut 620, and a reverse C-cut 622.

One or more apertures are provided at the panel area to provide ergonomic gripping of the bag near the bottom end of the bag at the first corner. In certain embodiments, the panel area is a continuous area in which one or more apertures are provided. For example, a single ovoid aperture may be provided, through which a user may insert one or more fingers.

The pour feature may include any suitable pour features known to those of ordinary skill in the art. For example, the pour feature may include a tearable, cuttable, or otherwise removable opening, or a recloseable opening, such as a press-to-close or slide zipper feature. In certain embodiments, the pour feature includes a fitment such as a spout.

Figure 4A:
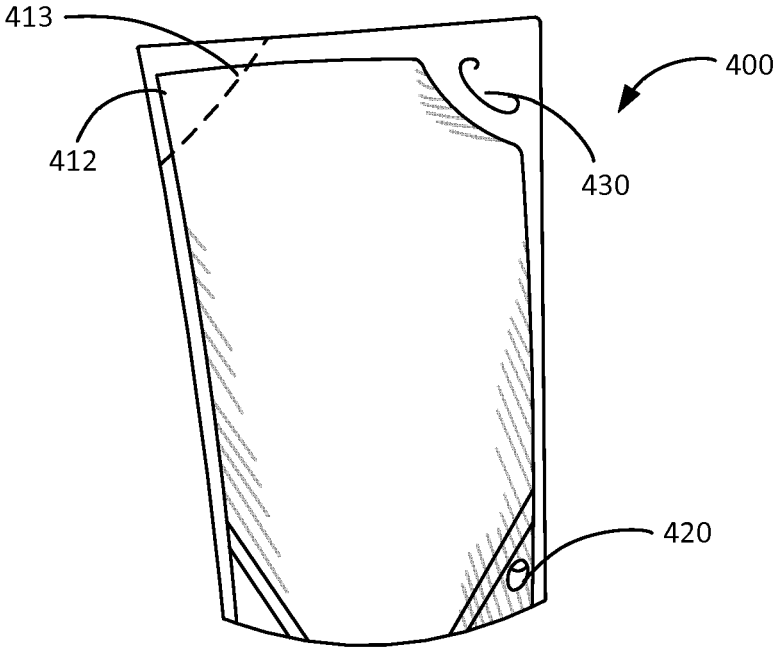
FIG. 4A is a perspective view, showing one embodiment of a container having a gusset grip feature.
Figure 4B:
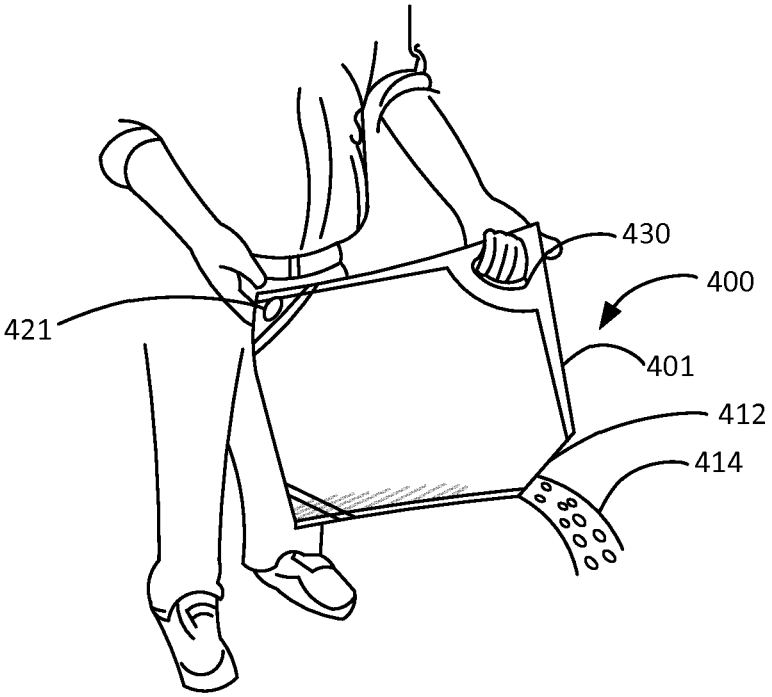
FIG. 4B is a perspective view, showing the container having a gusset grip feature of FIG. 4A.

In certain embodiments, as shown in FIG. 4A, the pour feature 412 includes one or more tear notches 413 configured to allow a user to tear open at least a portion of the container at the edge and/or corner at which the pour feature is disposed. As shown in FIG. 4B, the pour feature 412 may be disposed along all or a portion of a top edge 401 of the container 400, such that when a user grips the container through apertures 420, 421, bulk product 414 may be dispensed from the pour feature 412.

In certain embodiments, the container also includes a grip-enhancing feature. In certain embodiments, the grip-enhancing feature is disposed at a third corner opposite the first and second corners. That is, the grip-enhancing feature may be located at a corner on the top edge of the container opposite the corner from which product will be poured. The grip-enhancing feature may act as a fulcrum or pivot point when a user inserts a finger into each of the first and/or second apertures, to dispense the bulk product from the pour feature. The grip-enhancing feature, in combination with the gusset grip feature, allows the container to be gripped at two ends, providing a controlled pour from the pour feature. The grip-enhancing feature provides grip and leverage at the top of the container, serving as a fulcrum about which the bag may be tilted or rotated during product dispense.

Figure 5A:
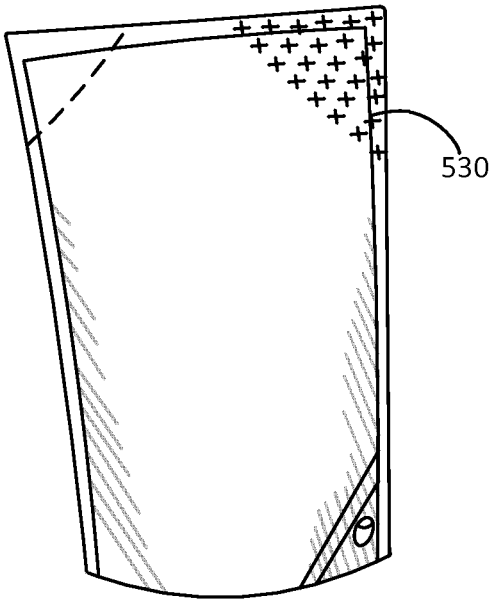
FIG. 5A is a perspective view, showing one embodiment of a container having a gusset grip feature.
Figure 5B:
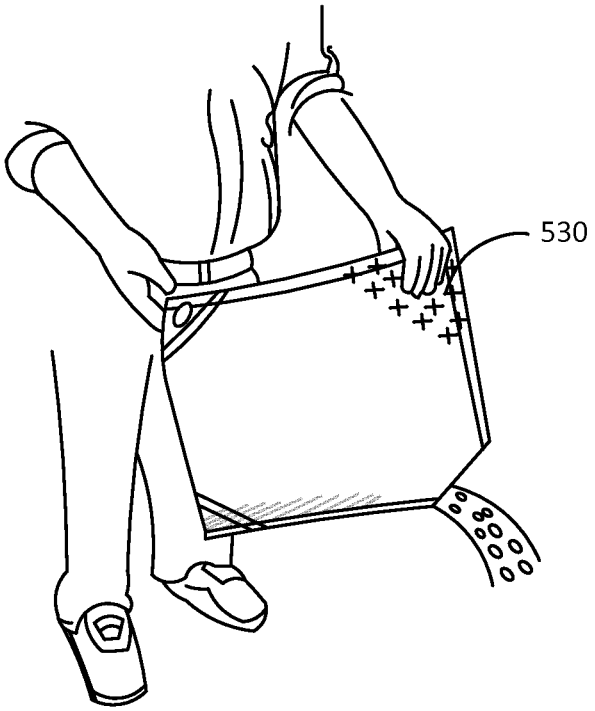
FIG. 5B is a perspective view, showing the container having a gusset grip feature of FIG. 4A.

In certain embodiments, as shown in FIGS. 4A-4B, the grip-enhancing feature includes a handle 430. For example, the handle may include one or more complete holes or partial cuts. These hole(s)/cut(s) may be round, ovoid, or otherwise profiled in shape. In another embodiment, as shown in FIGS. 5A-5B, the grip-enhancing feature includes a grip-enhancing material 530. For example, a tactile coating or material may be provided at the third corner to provide enhanced grip ability. In certain embodiments, the grip-enhancing feature is coated, glued, or applied as a label to the container.

These containers provide improved product dispensing and container handling, especially for higher net weight products (e.g., from about 10 up to about 60 pounds or more). The gusset grip feature provides an ergonomic way to grip and lift the bottom of the package for easy pouring. The gusset grip feature may be incorporated into a wide variety of container structures and materials that are typically used on large-format bag and/or heavy, bulk product applications, to facilitate easy transport, handling, and dispensing of large, heavy, or bulk products that are typically difficult to dispense.

Methods

In certain embodiments, methods of making a container having a gusset grip feature are provided. The containers may include any container features, or combinations of container features, described herein.

In one embodiment, a method for making a container includes: (i) forming a container having (a) an interior portion for containing a bulk product, (b) a first panel, (c) a second panel, the first and second panels being connected at a first edge and at a second edge opposite the first edge, to at least partially define the interior portion, (d) a bottom panel connecting the first and second panels at a third edge, to at least partially define the interior portion, (e) a panel area comprising a first aperture at a first corner of the container, the panel area being defined by a seal extending from the first edge, the seal at least partially defining the interior portion, such that the panel area is opposite the interior portion, and (f) a pour feature disposed at least partially at a second corner diagonally opposite the first corner, the pour feature being in communication with the interior portion and configured to dispense the bulk product, wherein the bottom panel or the first edge comprises a gusset, and (ii) forming at least one aperture in the panel area. In another embodiment, a method includes providing an at least partially pre-formed container and forming at least one aperture in the panel area of the at least partially pre-formed container.

For example, the at least one aperture may be formed inline during the container-making process, such as prior to any final folding or gluing. Alternatively, the at least one aperture may be formed in a form-fill-seal operation prior to any filling of the container with product. In one embodiment, the method further includes filling the container with a bulk product. For example, the container may be filled with from about 10 to about 60 pounds of the bulk product.

In certain embodiments, forming the at least one aperture includes die-cutting, punching, laser-scoring, laser-perforating, or any combination thereof. For example, the apertures may be completely or partially cut.

In one embodiment, forming the container includes sealing the first and second panels at the first and second edges. For example, the first and second edges may be lap sealed, fin sealed, or sealed by other suitable methods. In one embodiment, forming the container includes sealing the first and second panels to form the first pair of angled seals. In another embodiment, forming the container includes forming gussets at the first and second edges and sealing the first and second panels to form a seal extending between the first and the second edge. For example, the pair of seals may be formed by heat sealing, adhesive sealing, or other suitable sealing methods.

For example, where the container is a bottom gusset bag, such as a Doyen-style pouch (shown in FIGS. 1A-1C), a roll of film or laminate may be unwound from a roll and the film sheet may be passed over a former which forms the film into a W-profile, with the front and back panels being the outsides of the W and the gusset being the interior portion of the profile. The film may travel horizontally (e.g., the first edge of a second bag is adjacent the second edge of a first bag) (either upright or flatbed) and in the machine direction for the duration of the process. Seals may be made in a variety of ways, such as with resistance heated bars or ultrasonically. Any top end closures (e.g., zipper, slider, Velcro) may be inserted immediately after formation of the W-profile and before any of the side seals are made. At the end of the process, a knife or scissor may cut the pouches in the middle of the vertically sealed areas (e.g., between the first edge of the second bag and the second edge of the first bag) to create individual pouches.

For example, where the container is a side gusseted bag, such as a quad-seal bag (shown in FIGS. 2A-2C and 3A-3B), a roll of film or laminate is unwound from a roll and passed over a former (or series of formers) such that a 4-sided, closed profile is formed (rectangular in cross section). The lateral edges of the film may form a lap or fin seal in one of the panels or the lateral edges can be aligned in one of the corners and sealed there. Web travel of the bag may be along the longitudinal axis of the bag (e.g., a third edge of a first bag is adjacent the fourth edge of a second bag) and may be done on a flatbed machine. In embodiments in which the seal extends between the first and second edges, the bottom seal (forming the bottom panel in which product will be contained) keeps product out of the panel area that will eventually be folded and glued (or otherwise adhered). In some embodiments, machines that form these bags will cut off the rectangular tube and change the direction of travel (from machine direction (MD) to cross direction (CD)), and complete cross sealing, punching, zipper/slider insertion, etc., with the bag moving in a 90-degree orientation from which it started.

In certain embodiments, the method further includes forming a grip-enhancing feature at a third corner opposite the first and second corners. For example, forming the grip-enhancing feature may include forming a handle. For example, forming a handle may include die-cutting, punching, laser-scoring, laser-perforating, or any combination thereof. Alternatively, forming the grip-enhancing feature may include coating one or both of the first and second panels with a grip-enhancing material.

It will be appreciated that various above-disclosed and other features and functions, or alternatives thereof, may be desirably combined into many other different products or applications. Various presently unforeseen or unanticipated alternatives, modifications, variations, or improvements therein may be subsequently made by those skilled in the art which are also intended to be encompassed by the following claims.

We claim:

1. A container, comprising:

an interior portion for containing a bulk product;

a first panel;

a second panel, the first and second panels being connected at a first edge and at a second edge opposite the first edge, to at least partially define the interior portion;

a bottom panel connecting the first and second panels at a third edge, to at least partially define the interior portion, the bottom panel being configured to support the container in a standing configuration;

a panel area comprising a first aperture at a first corner of the container, the panel area being defined by a pair of angled seals extending between the first edge and the third edge, the seal at least partially defining the interior portion, such that the panel area is opposite the interior portion; and a pour feature disposed at least partially at a second corner diagonally opposite the first corner, the pour feature being in communication with the interior portion and configured to dispense the bulk product, wherein the bottom panel or the first edge comprises a gusset, wherein the first aperture is disposed between a first of the pair of angled seals and the first edge, such that the first aperture provides access to the gusset.

2. The container of claim 1, wherein the panel area further comprises a second aperture disposed between a second of the pair of angled seals and the first edge, such that the second aperture provides access to the gusset.

3. The container of claim 2, wherein the first and second apertures each comprise a circular or ovoid-shaped opening configured to receive a human finger.

4. The container of claim 2, wherein the first and second apertures each comprise a partial cut and a chad, configured to create an opening sized to receive a human finger.

5. The container of claim 4, wherein the partial cut comprises a C-cut or a D-cut.

6. The container of claim 1, wherein the first and second edges comprise one or more fin seals.

7. The container of claim 1, wherein the first and second edges comprise gussets.

8. The container of claim 4, further comprising a grip-enhancing feature disposed at a third corner opposite the first and second corners.

9. The container of claim 8, wherein the grip-enhancing feature is configured to act as a fulcrum when a user inserts a finger into the first aperture, to dispense the bulk product from the pour feature.

10. A method for making a container, comprising:

forming a container comprising:

an interior portion for containing a bulk product;

a first panel;

a second panel, the first and second panels being connected at a first edge and at a second edge opposite the first edge, to at least partially define the interior portion;

a bottom panel connecting the first and second panels at a third edge, to at least partially define the interior portion, the bottom panel being configured to support the container in a standing configuration;

a panel area comprising a first aperture at a first corner of the container, the panel area being defined by a pair of angled seals extending between the first and third edge extending from the first edge, the seal at least partially defining the interior portion, such that the panel area is opposite the interior portion; and a pour feature disposed at least partially at a second corner diagonally opposite the first corner, the pour feature being in communication with the interior portion and configured to dispense the bulk product;

wherein the bottom panel or the first edge comprises a gusset; and forming at least one aperture in the panel area between a first of the pair of angled seals and the first edge, such that the first aperture provides access to the gusset.

11. The method of claim 10, wherein forming the at least one aperture comprises die-cutting, punching, laser-scoring, laser-perforating, or any combination thereof.

12. The method of claim 10, further comprising filling the container with the bulk product.

13. The method of claim 12, wherein forming the at least one aperture occurs prior to filling the container.

14. The method of claim 10, wherein forming at least one aperture in the panel area occurs in-line with forming the container.

15. The method of claim 10, further comprising forming a grip-enhancing feature at a third corner opposite the first and second corners.

* * * * *

UNITED STATES PATENT AND TRADEMARK OFFICE

CERTIFICATE OF CORRECTION

PATENT NO. : 9,284,096 B2
APPLICATION NO. : 14/584647
DATED : March 15, 2016
INVENTOR(S) : David J. Kessler, Jr. et al.

It is certified that error appears in the above-identified patent and that said Letters Patent is hereby corrected as shown below:

In the Claims

At column 8, line 20, after "edge" delete "extending from the first edge."

Signed and Sealed this
Seventeenth Day of May, 2016

Michelle K. Lee

Michelle K. Lee
*Director of the United States Patent and Trademark Office*